US006473995B2

(12) United States Patent
Miyakawa et al.

(10) Patent No.: US 6,473,995 B2
(45) Date of Patent: Nov. 5, 2002

(54) VACUUM DRYING APPARATUS AND VACUUM DRYING METHOD

(75) Inventors: Shunji Miyakawa; Yasuhide Nakajima; Soichi Matsuo, all of Tokyo-to (JP)

(73) Assignee: Dai Nippon Printing Co., Ltd., Tokyo-to (JP)

( * ) Notice: Subject to any disclaimer, the term of this patent is extended or adjusted under 35 U.S.C. 154(b) by 0 days.

(21) Appl. No.: 09/791,519

(22) Filed: Feb. 23, 2001

(65) Prior Publication Data

US 2001/0015019 A1 Aug. 23, 2001

(30) Foreign Application Priority Data

Feb. 23, 2000 (JP) ..... 2000-045541

(51) Int. Cl.[7] ..... F26B 5/04
(52) U.S. Cl. ..... 34/403; 34/406; 34/92
(58) Field of Search ..... 34/402, 403, 406, 34/407, 92

(56) References Cited

U.S. PATENT DOCUMENTS 6,151,796 A * 11/2000 Karamatsu et al. ..... 34/403

FOREIGN PATENT DOCUMENTS

| | | | |
|---|---|---|---|
| JP | 401226157 A | * | 9/1989 |
| JP | 9134909 | | 5/1997 |
| JP | 9320949 | | 12/1997 |

* cited by examiner

*Primary Examiner*—Jiping Lu
(74) *Attorney, Agent, or Firm*—Ladas & Parry

(57) ABSTRACT

A vacuum drying apparatus and a vacuum drying method are provided wherein it is possible to reduce the drying time of an object to be dried and the surface condition of the object to be dried after drying is extremely satisfactory. A vacuum pump is connected to an exhaust port of a vacuum chamber through a suction pipe, and a frequency converter is provided on the input side of an alternating current motor for driving the vacuum pump to form a vacuum drying apparatus. A substrate coated with coating liquid is placed in the vacuum chamber of the vacuum drying apparatus. A gas in the vacuum chamber is exhausted at a high rate until the solvent evaporation rate of the solvent of the coating liquid comes to the vacuum degree that is slightly lower than the vacuum degree at which the evaporation rate of the solvent of the coating liquid is abruptly elevated, and thereafter, the gas in the vacuum chamber is exhausted at a low rate to cause the solvent of the coating liquid to evaporate gradually, and after evaporation of the solvent of the coating liquid, the pressure in the vacuum chamber are returned to the atmospheric pressure.

4 Claims, 5 Drawing Sheets

VACUUM DRYING APPARATUS AND VACUUM DRYING METHOD

BACKGROUND OF THE INVENTION

The present invention relates to a vacuum drying apparatus and a vacuum drying method, and more particularly, to a vacuum drying apparatus and a vacuum drying method in which a time required for drying can be reduced, and a drying surface of an object to be dried is satisfactory.

In the case of a color filter for an LCD, for example, a glass substrate is applied with coating liquid such as resist liquid and dried to form a desired pattern by such a photolithography or the like. As coating liquid application system, for example, a spin coating system, a knife coating system, a roll coating system, a bead coating system, or the like can be employed. In any case of application such as mentioned above, a drying process for drying a coating film is required to be taken before a pattern forming process. Conventionally, for an object to be dried such as a glass substrate coated with coating liquid, heat drying has been performed in an oven or a hot plate or the like.

The above method by heating requires long time for drying, and accordingly, in the manufacturing process of a color filter for an LCD as described above, the drying step of the glass substrate coating film has been the rate-determining step for the whole process. Accordingly, in recent years, a vacuum drying apparatus has come to be used so as to make it possible to reduce the time for the drying step. This is a system in which a glass substrate having a coating film is placed in a vacuum state to elevate the solvent evaporation rate to a remarkable extent.

However, even by using such a vacuum drying apparatus, it is invariable that the drying step occupies the rate-determining step for the whole process, and therefore, a further reducing of the time for the drying step is an important subject On the other hand, in the manufacturing process of the color filter for an LCD, the requirement is not only the reducing of the drying time but also the smoothness of the surface of the dried coating film on the glass substrate. In case of the drying by a simple rapid pressure reduction, irregularities are formed on the surface of the coating film to make the product not practically usable.

SUMMARY OF THE INVENTION

In view of the above circumstances, the present invention has been made, and its object is to provide a vacuum drying apparatus and a vacuum drying method wherein it is possible to reduce a drying time for an object to be dried and the surface condition of the object after drying is extremely satisfactory.

In order to attain the above object, a first invention of the vacuum drying apparatus comprises: a vacuum chamber provided with an exhaust port; a vacuum pump connected to the exhaust port of the vacuum chamber through a suction pipe; an alternating current motor for driving the vacuum pump; and a frequency converter provided on the input side of the alternating current motor.

Furthermore, the above vacuum drying apparatus further comprises a controller for detecting the vacuum degree in the vacuum chamber, adjusting the frequency converter by the preset vacuum degree to change an alternating current frequency to be introduced into the alternating current motor.

A second invention of the vacuum drying apparatus comprises: a vacuum chamber provided with an exhaust port; a vacuum pump connected to the exhaust port of the vacuum chamber through a suction pipe equipped with a shut-off valve; and a motor for driving the vacuum pump.

Furthermore, the above vacuum drying apparatus further comprises a controller for detecting the vacuum degree in the vacuum chamber, adjusting the shut-off valve by the preset vacuum degree to change an exhaust rate from the exhaust port.

A third invention of the vacuum drying apparatus comprises: a vacuum chamber provided with an exhaust port; a vacuum pump connected to the exhaust port of the vacuum chamber through a suction pipe equipped with a shut-off valve; an alternating current motor for driving the vacuum pump; and a frequency converter provided on the input side of the alternating current motor.

Furthermore, the above vacuum drying apparatus further comprises a controller for detecting the vacuum degree in the vacuum chamber, adjusting the frequency converter by the preset vacuum degree to change an alternating current frequency to be introduced into the alternating current motor, and/or adjusting the shut-off valve by the preset vacuum degree to change an exhaust rate from the exhaust port.

The vacuum drying method of the present invention is a vacuum drying method for placing a substrate coated with coating liquid containing solvent in a vacuum chamber, and evaporating the solvent in the coating liquid under reduced pressure, comprising:

an air eliminating step of reducing the pressure in the vacuum chamber to an exhaust rate changing pressure which is a pressure level slightly higher than the pressure at which the evaporation rate of the solvent in the coating liquid is rapidly elevated, a solvent evaporating step of reducing the pressure from the above exhaust rate changing pressure to the terminal pressure which is a pressure at which the evaporation of the solvent is completed, and an atmospheric pressure step of recovering the atmospheric pressure from the above terminal pressure, wherein the exhaust rate in the air eliminating step is set to a rate faster than the exhaust rate in the solvent evaporating step.

In the vacuum drying method of the present invention, the exhaust rate in the above air eliminating step is set to a rate faster than the exhaust rate in the above solvent evaporating step. Therefore, by making the exhaust rate extremely fast in the air eliminating step which does not affect the evaporation of the solvent contained in the coating liquid and making the exhaust rate in the solvent evaporating step which gives large effect on the smoothing of the coating surface into a speed necessary for smoothing, it becomes possible to expect, as a whole, to make the vacuum drying rate high and the coating surface smooth.

According to the present invention, the exhaust rate in the vacuum chamber at the time of the drying is made selectable in two steps, i.e., at first, the gas in the vacuum chamber is exhausted at a high rate to the vacuum degree which is slightly lower than the vacuum degree at which the evaporation rate of the solvent of the coating film is abruptly elevated, and next, the gas in the vacuum chamber is exhausted at a low rate to cause the solvent of the coating liquid to evaporate gradually. Accordingly, in the first stage exhaust above, it becomes. possible to reduce the drying time, and in the second stage exhaust, it is possible to make the coating surface quality uniform. In addition, in the vacuum drying apparatus of the present invention, by adjusting the frequency converter to change the alternate current frequency to be inputted to the alternate current motor for driving the vacuum pump, and/or by adjusting the shut-off valve provided on the suction pipe to change the exhaust rate from the exhaust port, the exhaust rate of the gas in the vacuum chamber can be optionally controlled. Therefore, it is possible to set in advance a vacuum degree that becomes a boundary between the first stage and the second stage in the above exhaust rate and to change over the exhaust rate from high rate to low rate, thereby reducing the drying time and making the surface condition after drying of the object to be dried extremely satisfactory.

DESCRIPTION OF THE PREFERRED EMBODIMENTS

Hereinafter, embodiments according to the present invention will be explained.

First Invention of the Vacuum Drying Apparatus

Figure 1:
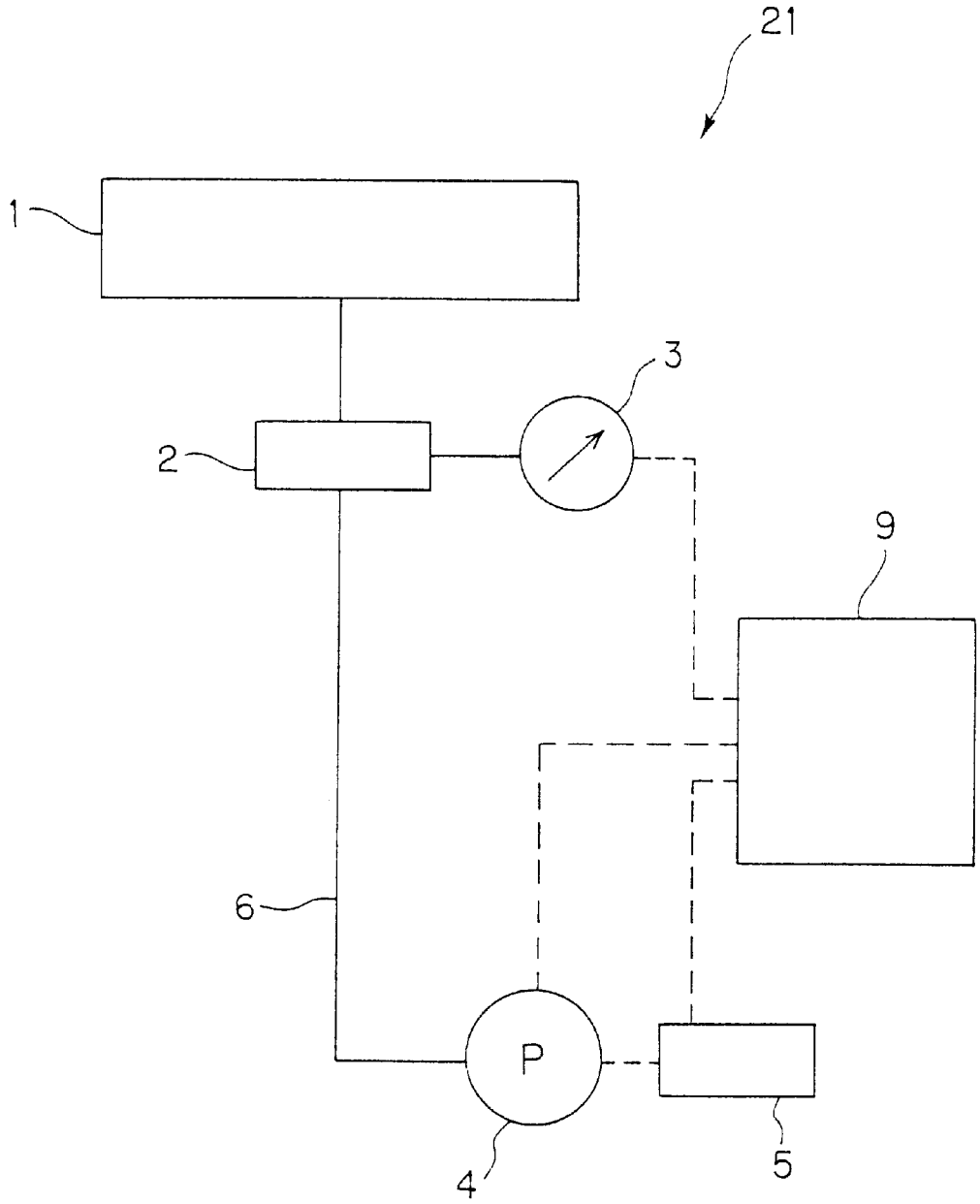
FIG. 1 is a schematic configuration diagram showing an embodiment of a vacuum drying apparatus according to the present invention.

FIG. 1 is a schematic configuration diagram showing an embodiment of a vacuum drying apparatus according to the present invention. In FIG. 1, a vacuum drying apparatus 21 of the invention comprises a vacuum chamber 1, a vacuum pump 4 connected to the exhaust port of the vacuum chamber 1 through the suction pipe 6, a manifold 2 provided on the suction pipe 6, a vacuum gauge 3 connected to the manifold 2 through a pipe, a frequency converter 5 electrically connected to the input side of the alternating current motor of the vacuum pump 4, and a controller 9 which is electrically connected to the vacuum gauge 3, vacuum pump 4, and frequency converter 5.

Figure 2:
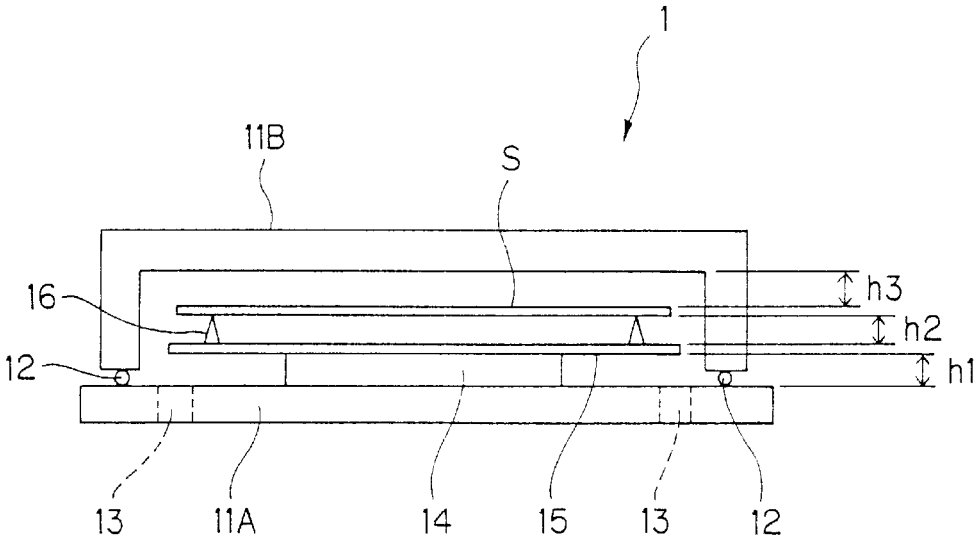
FIG. 2 is a schematic configuration diagram showing a vacuum chamber of the vacuum drying apparatus illustrated in FIG. 1.

The vacuum chamber 1 has, as shown in FIG. 2, a bottom part 11A and a lid case 11B engaged in an air-tight condition through an O-ring 12. On the bottom part 11A, there are formed a plurality of exhaust ports 13. An under-plate 15 is provided on the bottom part 11A through a platform 14, and a plurality of support pins 16 are provided on the under-plate 15.

An exhaust port 13 provided on the bottom part 11A of the vacuum chamber 1 is connected to a vacuum pump 4 through a suction pipe 6. The gas in the vacuum chamber 1 is discharged outside from the exhaust port 13, so that the inside of the vacuum chamber 1 can be brought to a predetermined vacuum state. This exhaust port 13 may be formed in a position in which the gas can be uniformly exhausted in the vacuum chamber 1, and no particular restriction is provided for the number, position, etc. of th exhaust port.

The under-plate 15 which constitutes the vacuum drying apparatus 1 may be the one formed of the material of aluminum, SUS, iron, copper, resin, or the like. It is preferable for the under-plate 15 to have an area in the range of 70 to 99% of the area of the bottom part of the vacuum chamber 1. It is further preferable to make the distance between the peripheral part of the under-plate 15 and the side wall part of the lid case 11B of the vacuum chamber.1 uniform as far as possible, and to set its distance at 0.5 cm or more. Further, the under-plate 15 may be set to be vertically movable by the platform 14, and in this case the adjustable range of the height h1 of the under-plate 15 can be, for example, about 2 to 50 mm.

The support pin 16 provided on the under-plate 15 is for floating a substrate S coated with the coating liquid which is an object to be dried to a desired distance from the surface of the under-plate 15 to hold, and it can be formed into one having an optional shape such as conical, columnar, square post shape, and the like. The number and position of formation of the support pin 16 are not particularly limited, and the height h2 of the support pin 16 can be set in a range of about 0.5 to 10 mm. The support pin 16 can be usable one formed by selecting a material that does not harm the substrate S, and it may be arranged by fixing on the surface of the under-plate 15.

Such a vacuum chamber 1 preferably has a distance h3 between the substrate S and the lid case 11B of the vacuum chamber 1 when the substrate S is placed on the support pin 16 is in the range of 1 to 10 mm. The adjustment of this distance h3 can be made, for example, by the adjustment by the platform 14 or the change in height of the support pin 16 as described above.

The manifold 2 which constitutes the vacuum drying apparatus 21 and the vacuum gauge 3 connected to the manifold 2 through the piping act to detect the vacuum degree in the vacuum chamber 1 and send the detection signal to the controller 9. For these parts, those so far known can be used.

The vacuum pump 4 which constitutes the vacuum drying apparatus 21 is to be driven by the alternating current motor. By adjusting the frequency converter 5 which is electrically connected to the input side of the alternating current motor, the frequency of the alternating current inputted in the alternating current motor can be changed to control the suction capacity of the vacuum pump 4. As such vacuum pump 4 and frequency converter 5, the conventional products may be used.

Second Invention of the Vacuum Drying Apparatus

Figure 3:
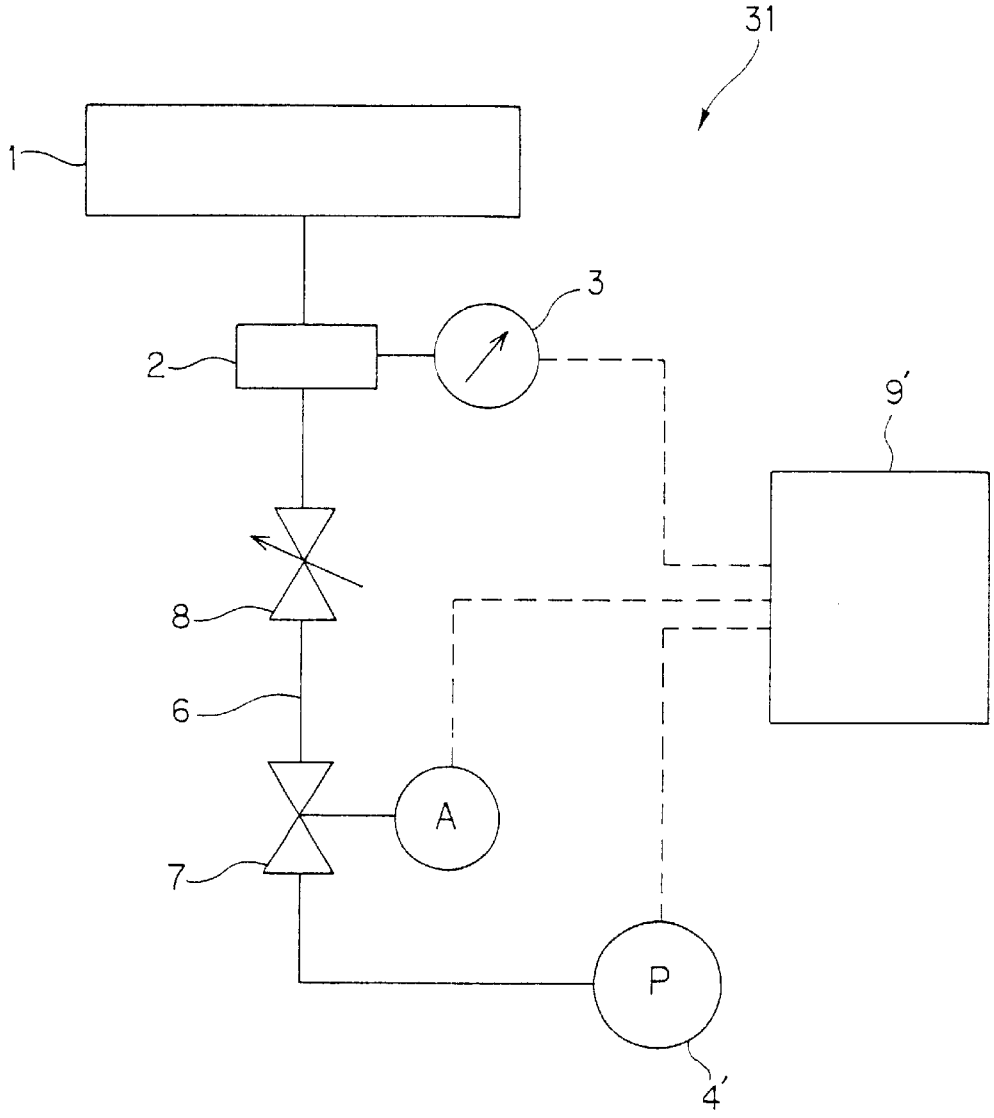
FIG. 3 is a schematic configuration diagram showing another embodiment of the vacuum drying apparatus according to the present invention.

FIG. 3 is a schematic configuration diagram showing another embodiment of the vacuum drying apparatus of the present invention. In FIG. 3, a vacuum drying apparatus 31 of the invention comprises a vacuum chamber. 1, a vacuum pump 4' connected to the exhaust port of the vacuum chamber 1 through the suction pipe 6, a manifold 2 provided on the suction pipe 6, an automatic shut-off valve 7, a manual shut-off valve 8, a vacuum gauge 3 connected to the manifold 2 through a pipe, and a controller 9' which is electrically connected to the vacuum gauge 3, vacuum pump 4', and automatic shut-off valve 7.

The vacuum chamber 1, manifold 2, and vacuum gauge 3 which constitute such vacuum drying apparatus 31 are similar to the vacuum chamber 1, manifold 2, and vacuum gauge 3 that constitute the above vacuum drying apparatus 21, and the explanation on them is omitted here.

The vacuum pump 4' that constitutes the vacuum drying apparatus 31 may be driven either by the alternating current motor or by the direct current motor, for which the conventionally known one may be used.

The automatic shut-off valve 7 which constitutes the vacuum drying apparatus 31 is designed to change the exhaust rate from the exhaust port 13 of the vacuum chamber 1 by adjusting the shut-off degree under control by the controllers 9' on receipt of the vacuum degree detection signal from the vacuum gauge 3. Such an automatic shut-off valve 7 is not particularly limited but the one conventionally known may be used. In the illustrated example, a manual shut-off valve 8 is provided so as to allow changing of the exhaust rate from the exhaust port 13 of the vacuum chamber 1 even manually. The manual shutoff valve 8 is also not specifically limited, and conventionally available one may be used.

Third Invention of the Vacuum Drying Apparatus

Figure 4:
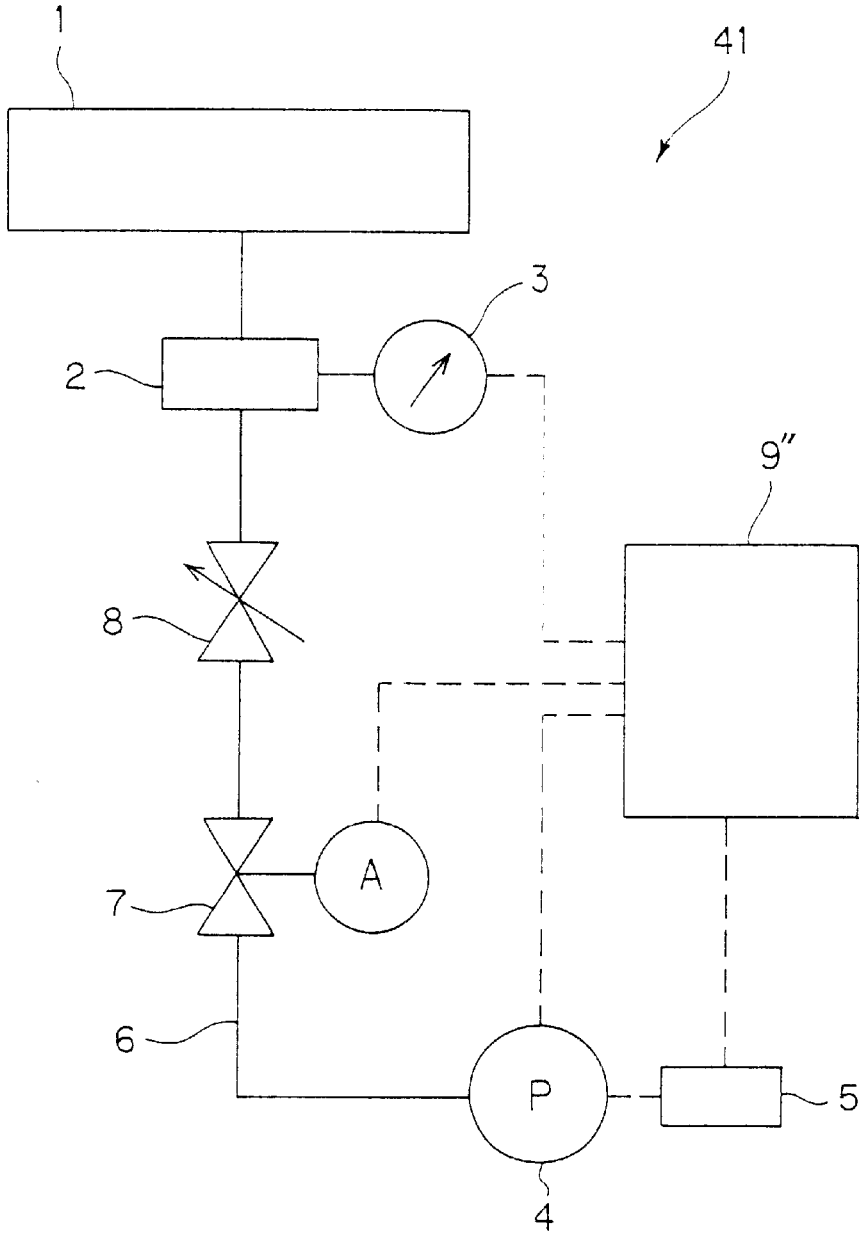
FIG. 4 is a schematic configuration diagram showing another embodiment of the vacuum drying apparatus according to the present invention.

FIG. 4 is a schematic configuration diagram showing the other embodiment of the vacuum drying apparatus of the present invention. In FIG. 4, a vacuum drying apparatus 41 of the invention comprises a vacuum chamber 1, a vacuum pump 4 connected to the exhaust port of the vacuum chamber 1 through the suction pipe 6, a manifold 2 provided on the suction pipe 6, an automatic shut-off valve 7, a manual shut-off valve 8, a vacuum gauge 3 connected to the manifold 2 through a pipe, a frequency converter 5 which is electrically connected to the input side of the alternating current motor of the vacuum pump 4, and a controller 9" which is electrically connected to the vacuum gauge 3, vacuum pump 4, frequency converter 5, and automatic shut-off valve 7.

The vacuum chamber 1, manifold 2, vacuum gauge 3, vacuum pump 4, and frequency converter 5 which constitute such vacuum drying apparatus 41 are similar to the vacuum chamber 1, manifold 2, vacuum gauge 3, vacuum pump 4, and frequency converter 5 that constitute the above vacuum drying apparatus 21, and the explanation on them is omitted here. Further, an automatic shut-off valve 7 and a manual shut-off valve 8 that constitute the vacuum drying apparatus 41 are similar to the automatic shut-off valve 7 and the manual shut-off valve 8 that constitute the vacuum drying apparatus 31, and the explanation on them is omitted here.

The controller 9" which constitutes the vacuum drying apparatus 41 is designed to change the exhaust rate from the exhaust port 13 of the vacuum chamber 1 through such step, on receipt of the vacuum degree detection signal from the vacuum gauge 3, when the predetermined vacuum degree has been reached, issuing a signal to the frequency converter 5 to change the alternating current frequency inputted to the alternating current motor of the vacuum pump 4 or issue a signal to the automatic shut-off valve 7 to cause a change to the shut-off degree.

Vacuum Drying Method of the Present Invention

Next, a preferred embodiment of a vacuum drying method according to the present invention is explained on the basis of the case of using a vacuum drying apparatus 21 of the invention shown in FIG. 1.

The vacuum drying method of the pre sent invention is to effect vacuum drying in two steps of the exhaust rate in the vacuum chamber 1 by placing a substrate S coated with coating liquid containing solvent on support pins 16 in a vacuum chamber That is to say, as a first step, an air eliminating step is performed by a method of reducing the pressure in the vacuum chamber 1 to an exhaust rate changing pressure which is the pressure level slightly higher than the pressure level at which the evaporation rate of the solvent in the coating liquid shows abrupt rise. The exhaust rate in this case is at a high rate. Next, as a second step, when the vacuum gauge 3 detects the attainment at the predetermined vacuum level and sends a signal to the control device 9 of the vacuum drying apparatus 21, the control device 9 which received the detection signal adjusts the frequency converter 5 and changes the alternate current frequency for supply to the alternate current motor to drive the vacuum pump 4, reduces the number of revolutions of the alternate current motor, and retards the exhaust rate of the gas in the vacuum chamber 1. By this, the solvent of the coating liquid gradually evaporates at approximately constant vacuum degree. Next, at the time when the evaporation of the solvent of the coating liquid is completed to come to the terminal pressure at which the vacuum degree which had been approximately constant starts to change again, the pressure in the vacuum chamber 1 are instantly reverted to atmospheric pressure to complete vacuum drying.

Figure 5:
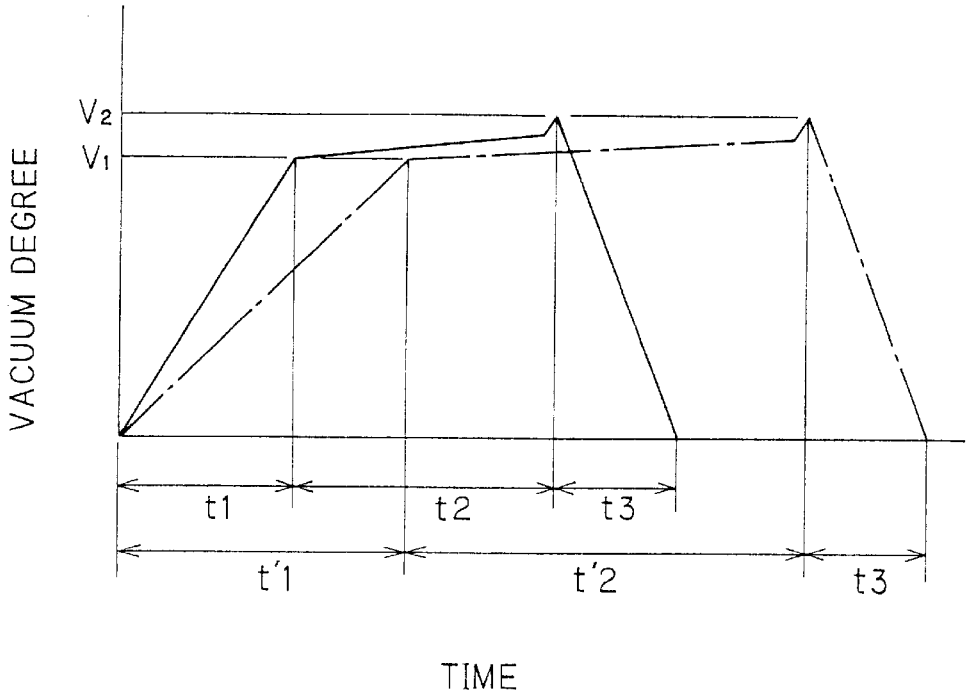
FIG. 5 is a graph showing the relationship between the time from the start of exhaust in the vacuum chamber and the vacuum degree in the vacuum drying method according to the present invention.

FIG. 5 is a graph showing the relationship between the time from the start of exhaust in the vacuum chamber 1 and the vacuum degree in the vacuum drying method of the present invention as mentioned above. As shown in FIG. 5, the gas in the vacuum chamber 1 is exhausted at a high rate up to an exhaust rate changing pressure v1 which is a pressure slightly higher than the pressure at which the evaporation rate of the solvent of the coating liquid is sharply elevated. The time required for this process, i.e., the time required for the air eliminating step, is assumed to be t1. Next, the gas in the vacuum chamber 1 is exhausted at a slow rate to evaporate the solvent of the coating liquid gradually up to the terminal pressure v2 at which evaporation of the coating liquid is completed (the vacuum degree which had been approximately constant again shows variation.). The time required for it, i.e., the time required for the solvent evaporating step, is assumed to be t2. Thereafter, the pressure in the vacuum chamber 1 are returned to the atmospheric pressure (the time required, i.e., the time required for the step of regaining the atmospheric pressure, is assumed to be t3). Then, the substrate S is taken out from the vacuum chamber 1 to complete the vacuum drying. In this sequential operation, the time required in the air eliminating step, t1, can be reduced, and it becomes possible to make the drying at high rate. In addition, it is possible to expect smoothing of the coating surface by the low rate exhaustion in the solvent evaporating step. Consequently, the time required for vacuum drying, T=t1+t2+t3, is curtailed, and it becomes possible to attain smoothing of the coating surface.

Against this, in case of vacuum drying by the low rate exhaustion in the range in which smoothing of the coating surface is impossible, i.e., when the exhaust rate in the air eliminating step and the exhaust rate in the solvent evaporating step are set to be the same exhaust rate, as shown in an alternate short and long dash line in FIG. 5, the time t1 required for the air eliminating step increases, so that the time required for vacuum drying, T'=t'1+t'2+t3, shows largely increase in comparison with the one of the solid line which is the example of the present invention as mentioned above.

As described above, the present invention has its characteristic feature in previously determining the exhaust rate changing pressure, exhausting the air at high rate in the air eliminating step up to the exhaust changing pressure; and performing gradual exhaustion at a lower exhaust rate in the solvent evaporating step after change into the exhaust rate changing pressure. Here, the exhaust rate changing pressure is a pressure slightly higher than the pressure at which the evaporation rate of the solvent in the coating liquid is abruptly elevated. This pressure may be set to a level slightly higher than the pressure at which the evaporation rate is abruptly elevated, which is previously measured by experiment, such pressure to be set is substantially about 0 Pa to 133 Pa higher than the measured pressure.

Furthermore, this exhaust rate changing pressure may be set to a level higher than the vapor pressure of the solvent in the coating liquid. In this case alike; normally the pressure is set to be about 0 Pa to 133 Pa higher than the vapor pressure of the solvent.

The solvent evaporating step as described above is carried out until the terminal pressure at which the evaporation of the solvent is completed. Although this terminal pressure may be determined by eye vision or by previously conducted experiment, preferably it is set to be a pressure at which the pressure reduction rate starts to rise abruptly at the time when the pressure reduction is performed at a certain exhaust rate in the above solvent evaporating step. This pressure at which the pressure reduction rate starts to rise abruptly is shown, for example, in FIG. 5, by the pressure v2 at which the vacuum degree rises abruptly. In this manner, the abrupt rise of the pressure reduction rate is considered to signify that the solvent in the coating liquid has completely evaporated.

In the foregoing embodiments of the vacuum drying method of the present invention, an example is taken on the case of using the vacuum drying apparatus 21 shown in FIG. 1, but the vacuum drying is carried out in the same manner in the case of using the vacuum drying apparatus 31 shown in FIG. 3, and the vacuum drying apparatus 41 shown in FIG. 4.

That is to say, in case of using the vacuum drying apparatus 31 as shown in FIG. 3, when the vacuum degree in the vacuum chamber 1 becomes the exhaust rate changing pressure v1 by the high rate exhaust in the air eliminating step of the first stage, the vacuum gauge 3 sends a detection signal to the controller 9' of the vacuum drying apparatus 31, and the controller 9' which has received this detection signal issues a signal to the automatic shut-off valve 7 to adjust the shut-off degree and lower the exhaust rate, and under the condition, it causes to evaporate the solvent of the coating liquid gradually. Further, in case of using the vacuum drying apparatus 41 as shown in FIG. 4, when the vacuum degree in the vacuum chamber 1 becomes the exhaust rate changing pressure v1 by the high rate exhaust in the air eliminating step, the vacuum gauge 3 sends a detection signal to the controller 9" of the vacuum drying apparatus 31, and the controller 9" which has received this detection signal adjusts to the frequency converter 5 to change the alternating current frequency inputted to the alternating current motor of the vacuum pump 4 so as to reduce the number of revolution of the alternating current motor and/or issues a signal to the automatic shut-off valve 7 to adjust the shut-off degree and lower the exhaust rate, and under the condition of retarding the exhaust rate of the gas in the vacuum chamber 1, it causes to evaporate the solvent of the coating liquid gradually.

In the present invention, no particular limitation is provided for the coating liquid which becomes the subject of drying.

EXAMPLE

Next, the present invention is explained in more detail by way of the example.

At first, coating liquid of the following composition was prepared.

Composition of coating liquid

Solid content: 20% by weight

Solvent used: 3-methoxybutyl acetate (boiling point: 173° C., vapor pressure at 30° C.: $3.99\times10^2$Pa)

Next, this coating liquid was applied to a glass substrate having thickness of 0.7 mm by spin coat process (film thickness 1.8 $\mu$m).

Example

A vacuum drying apparatus as shown in FIG. 1 equipped with a vacuum chamber as shown in FIG. 2 was prepared, and a glass substrate coated with the above coating liquid was placed on the support pin in the vacuum chamber.

Inner volume of chamber: 7638.4 $cm^3$

Bottom plate configuration: Rectangular

Height in chamber: 16 mm

Under-plate area: 4554.16 $cm^3$

Under-plate thickness: 2 mm

Under-plate height h1: 2 mm

Support pin height h2: 6 mm

Height from substrate to lid-case h3: 5 mm

Alternate current vacuum pump: HC450 made by Kashiyama Kogyo

Variable frequency of frequency converter: 40 to 70 Hz

At first, as an air eliminating step of the first stage, until the vacuum degree in the condition where the temperature in the vacuum chamber was at room temperature (23° C. came to be $3.99\times10^2$ Pa, i.e., until the vacuum degree came to a level slightly lower than the vapor pressure of the solvent at 23° C. (corresponding to exhaust rate changing pressure), the vacuum pump was driven at the alternate current frequency of 60 Hz. The time required for this air eliminating step (first stage) t1 (corresponding to t1 in FIG. 5) was 6.2 seconds.

Next, as a solvent evaporating step of the second stage, at the time when the vacuum degree in the vacuum chamber came to be $3.99\times10^2$ Pa, the alternating current frequency for intake of the frequency exchanger into the alternating current motor was changed to 50 Hz, and drying of the coating film by the low rate exhaust, namely, the solvent evaporating step, was commenced. The time t2 (corresponding to the terminal pressure) required until the coating film drying was completed in this solvent evaporating step and the vacuum degree which had been approximately constant came to change again (to the terminal pressure) was 10.4 seconds.

Next, the valve in the vacuum chamber was opened and atmospheric air was gradually introduced to bring to an atmospheric pressure. The time t3 (corresponding to t3 in FIG. 5) required for this step was 10.2 seconds.

In this vacuum drying, the total drying time T (t1+t2 +t3) from the start of suction to the completion of drying (the time at which the drying of the coating film is completed and the vacuum degree which had been approximately constant comes to change again), and the time to bring to an atmospheric pressure in the vacuum chamber was 26.8 seconds. And, the surface condition of the coating film after drying was satisfactory.

Comparative Example 1

Using the same vacuum drying apparatus as that of Example, a vacuum pump was driven at the alternating current frequency of 50 Hz to carry out drying of the coating film. The time t'1+t'2 (corresponding to t'1+t'2 in FIG. 5) required for the period from the start of suction to the point at which the drying of the coating film was completed and the vacuum degree which had been approximately constant comes to change again was 19.9 seconds.

Next; the valve of the vacuum chamber was opened and atmospheric air was gradually introduced to bring to: an atmospheric pressure. The time t3 (corresponding to t3 in FIG. 5) required for this step was 10.2 seconds.

Though the coating film after the vacuum drying had satisfactory surface condition, the total drying time T' (t'1+t'2+t3) was 30.1 seconds, being 3.3 seconds longer than that of Example.

Comparative Example 2

Using the same vacuum drying apparatus as that of Example, a vacuum pump was driven at the alternating current frequency of 45 Hz for 32.0 seconds to carry out drying of the coating film.

Next, the valve of the vacuum chamber was opened and atmospheric air was gradually introduced to bring to an atmospheric pressure. The time t3 (corresponding to t3 in FIG. 5) required for this step was 10.2 seconds.

In this vacuum drying, regardless of the use of 42.2 seconds for the total drying time, the coating film after drying showed irregularity and unsatisfactory results.

Comparative Example 3

Using the same vacuum drying apparatus as that of Example, a vacuum pump was driven at the alternating current frequency of 65 Hz to carry out drying of the coating film. The time t'1+t'2 (corresponding to t'1+t'2 in FIG. 5) required for the period from the start of suction to the point at which the drying of the coating film was completed and the vacuum degree which had been approximately constant comes to change again was 11.7 seconds.

Next, the valve of the vacuum chamber was opened and atmospheric air was gradually introduced to bring to an atmospheric pressure. The time t3 (corresponding to t3 in FIG. 5) required for this step was 10.2 seconds.

In this vacuum drying, the total drying time T' (t'1+t'2+t3) was 21.9 seconds, being 4.9 seconds shorter than that of Example, but the surface condition of the coating film after drying was unsatisfactory, showing the crater like irregularity (unevenness caused by bumping of solvent).

What is claimed is:

1. A vacuum drying method for placing a substrate coated with coating liquid containing solvent in a vacuum chamber and evaporating the solvent in the coating liquid under-reduced pressure, comprising:

an air eliminating step of reducing the pressure in the vacuum chamber to an exhaust rate changing pressure which is a pressure level slightly higher than the pressure at which the evaporation rate of the solvent in the coating liquid is rapidly elevated, a solvent evaporating step of reducing the pressure from the above exhaust rate changing pressure to the terminal pressure which is a pressure at which the evaporation of the solvent is completed, and an atmospheric pressure 'step of recovering the atmospheric pressure from the above terminal pressure, wherein the exhaust rate in the air eliminating step is set to a rate faster than the exhaust rate in the solvent evaporating step.

2. The vacuum drying method according to claim 1, wherein the exhaust rate changing pressure is set to be higher than the vapour pressure of the solvent contained in the coating liquid.

3. The vacuum drying method according to claim 2, wherein the terminal pressure is set to be such a pressure that the pressure reduction rate abruptly rises when pressure reduction is effected at a constant exhaust rate in the solvent evaporating step.

4. The vacuum drying method according to claim 1, wherein the terminal pressure is set to be such a pressure that the pressure reduction rate abruptly rises when pressure reduction is effected at a constant exhaust rate in the solvent evaporating step.

* * * * *